United States Patent [19]

Korenko

[11] 4,377,553

[45] Mar. 22, 1983

[54] DUCT AND CLADDING ALLOY

[75] Inventor: Michael K. Korenko, Rockville, Md.

[73] Assignee: The United States of America as represented by the United States Department of Energy, Washington, D.C.

[21] Appl. No.: 155,231

[22] Filed: May 28, 1980

[51] Int. Cl.[3] ..... C22C 30/00

[52] U.S. Cl. ..... 420/584; 75/124

[58] Field of Search ..... 75/122, 134 F, 124

[56] References Cited

U.S. PATENT DOCUMENTS 4,129,462 12/1978 Korenko ..... 75/122

4,236,943 12/1980 Korenko et al. ..... 75/122

OTHER PUBLICATIONS

Nimonic Alloy PE16, Publication 3349A, Jan. 1968, Henry Wiggin and Co. Ltd.

*Primary Examiner*—R. Dean

*Attorney, Agent, or Firm*—John J. Prizzi

[57] ABSTRACT

An austenitic alloy having good thermal stability and resistance to sodium corrosion at 700° C. consists essentially of 35–45% nickel
7.5–14% chromium
0.8–3.2% molybdenum
0.3–1.0% silicon
0.2–1.0% manganese
0–0.1% zirconium
2.0–3.5% titanium
1.0–2.0% aluminum
0.02–0.1% carbon
0–0.01% boron and the balance iron.

2 Claims, No Drawings

DUCT AND CLADDING ALLOY

GOVERNMENT CONTRACT CLAUSE

This invention was made in the course of, or under, a contract with the U.S. Department of Energy.

BACKGROUND OF THE INVENTION

1. Field of the Invention

The present invention relates to an improved alloy composition, and more particularly an austenitic alloy which is particularly useful as a cladding for nuclear reactor fuel pins and for use as a duct forming material.

2. Description of the Prior Art

There are numerous Ni-Cr-Fe alloys which retain significant strength properties at elevated temperatures. There is a need for such temperature stable alloys which will resist sodium corrosion at elevated temperatures. This requirement results from the need to contain molten sodium in nuclear energy generators.

SUMMARY OF THE INVENTION

An alloy having useful thermal stability at temperatures of 700° C. and useful resistance to sodium corrosion at temperatures of 700° C. consists essentially of 35–45% nickel
7.5–14% chromium
0.8–3.2% molybdenum
0.3–1.0% silicon
0.2–1.0% manganese
0–0.1% zirconium
2.0–3.5% titanium
1.0–2.0% aluminum
0.02–0.1% carbon
0–0.01% boron and the balance iron.

DESCRIPTION OF THE PREFERRED EMBODIMENTS

An austenitic alloy (herein ALLOY I) was prepared having the following composition:

nickel—40%
chromium—10.5%
molybdenum—2.0%
silicon—0.5%
manganese—0.2%
zirconium—0.05%
titanium—3.3%
aluminum—1.7%
carbon—0.03%
boron—0.005% balance iron.

A thermal stability aging test was carried out with this alloy at 700° C. for 1000 hours. A microscopic examination of the material confirmed the stability of the alloys and established the presence of the gamma-prime strengthening phase. The material was subjected to neutron irradiations over a wide temperature range, exhibiting only slight swelling.

A sodium corrosion test of the alloy at 700° C. for 1000 hours indicated a low corrosion rate.

The alloys of this invention, when compared with predecessors, have greater fabricability and weldability; a lower neutron-absorption factor; reduced swelling at elevated temperatures; and improved resistance to sodium corrosion.

The test results compare the present ALLOY I with known predecessor alloys as follows:

ALLOY II—NIMONIC PE-16, an alloy produced by H. Wiggins, United Kingdom. Composition: Ni—43.5; Cr—16.5; Mo—3.3; Si—0.35; Mn—0.1; Zr—0.05; Ti—1.2; Al—1.2; C—0.05; B—0.01; Balance—Iron.

ALLOY III—An alloy with the following composition: Ni—45; Cr—12; Mo—3.3; Si—0.5; Zr—0.05; Ti—2.5; Al—2.5; C—0.03; B—0.005; Balance—Iron.

TEST RESULTS

FABRICABILITY—ALLOY I produced tubes by drawing which were superior to those from ALLOY III.

WELDABILITY—ALLOY I could be readily welded to itself by electron beam welding without forming weld cracks. ALLOY III did not exhibit satisfactory weldability.

NEUTRON ABSORPTION—The neutron absorption factor, based upon AISI alloy 316 as a reference is:

| | |
|---|---|
| ALLOY I | 1.24 |
| ALLOY II | 1.27 |
| ALLOY III | 1.27 |

which indicates superiority of ALLOY I.

FLOWING SODIUM CORROSION—Samples of ALLOYS I, II and III were tested in flowing sodium at 700° C. for 936 hours. The extrapolated yearly loss in alloy thickness from flowing sodium corrosion is

| Alloy | Loss in Thickness |
|---|---|
| I | 5 microns/year |
| II | 10 microns/year |
| III | 13 microns/year |

SWELLING PROPERTIES—Samples of ALLOYS I and II were exposed for extended periods of neutron bombardment at various temperatures. The results are set forth in the following table:

| NEUTRON EXPOSURE (Neutrons/sq. cm) | ALLOY I $7.8 \times 10^{22}$ | ALLOY II $5.9 \times 10^{22}$ |
|---|---|---|
| Temperature, °C. | Increase in density, % | |
| 400 | −0.16 | +0.001 |
| 427 | +0.58 | −0.048 |
| 454 | +0.16 | +0.039 |
| 482 | +0.01 | +0.26 |
| 510 | +0.16 | +0.78 |
| 538 | −0.15 | +0.89 |
| 593 | −0.37 | +1.36 |
| 649 | −0.40 | −0.12 |

ALLOY I exhibits, overall, less swelling. Note that negative values in the table indicate shrinking, distinguished from swelling.

Ducts fabricated from the present ALLOY I are useful for confining fuel pins for nuclear reactors.

I claim:

1. An austenitic alloy consisting essentially of nickel—40%
chromium—10.5%
molybdenum—2.0%
silicon—0.5%
manganese—0.2%
zirconium—0.05%
titanium—3.3%
aluminum—1.7%
carbon—0.03%
boron—0.005% balance iron.

2. A duct fabricated from the alloy of claim 1.

* * * * *